United States Patent [19]

Schaub et al.

[11] Patent Number: 4,705,376

[45] Date of Patent: Nov. 10, 1987

[54] PROCESS AND APPARATUS FOR TREATING OBJECTS FORMING SEPARATE SERIES

[75] Inventors: Heiner Schaub, Wettingen; Peter Bürki, Opfikon, both of Switzerland

[73] Assignee: Gretag Aktiengesellschaft, Regensdorf, Switzerland

[21] Appl. No.: 897,252

[22] Filed: Aug. 18, 1986

[30] Foreign Application Priority Data

Aug. 19, 1985 [CH] Switzerland ..... 3559/85

[51] Int. Cl.[4] ..... G03D 5/00

[52] U.S. Cl. ..... 354/298; 354/319; 355/28; 209/552; 271/298; 271/299; 271/300

[58] Field of Search ..... 354/298, 319, 320, 322; 270/58; 271/298, 299, 300; 134/56 R, 57 R, 58 R; 355/27, 28; 209/539, 552, 563, 564, 584, 900

[56] References Cited

U.S. PATENT DOCUMENTS

| | | | |
|---|---|---|---|
| 3,915,785 | 10/1975 | Muller | 156/351 |
| 4,034,973 | 7/1977 | Hams | 270/58 |
| 4,114,349 | 9/1978 | Jensen et al. | 53/54 |
| 4,140,627 | 2/1979 | Weller | 209/584 |
| 4,314,644 | 2/1982 | Stocker | 209/584 |
| 4,456,127 | 6/1984 | Hams | 209/564 |
| 4,556,305 | 12/1985 | Osegowitsch | 354/298 |
| 4,589,555 | 5/1986 | Hollingsworth | 209/900 |

FOREIGN PATENT DOCUMENTS

| | | |
|---|---|---|
| 1256448 | 12/1967 | Fed. Rep. of Germany . |
| 2723573 | 11/1978 | Fed. Rep. of Germany . |
| 1111847 | 5/1968 | United Kingdom . |

*Primary Examiner*—A. A. Mathews

*Attorney, Agent, or Firm*—Burns, Doane, Swecker & Mathis

[57] ABSTRACT

In a production line for photographic copies the individual sheets leaving the copy portion of the production line are distributed over a plurality of output conveyors and transported in accordance to a predetermined distribution pattern through a subsequent wet treatment and drying station. For facilitating subsequent collection of copies by order, a separation mark in the form of a deviation from the predetermined distribution pattern is inserted between separate orders on said output conveyors. The separation marks may be detected after the wet treatment station by a light barrier sensing device or the like, and used for controlling automatic sorting devices to collect copies by order.

20 Claims, 18 Drawing Figures

10
20a
20b
20c
20d
70
11
12
13
14
A1
A2
A3
A4
A5
A6
A7
B1
B2
B3
B4
B5
B6
B7

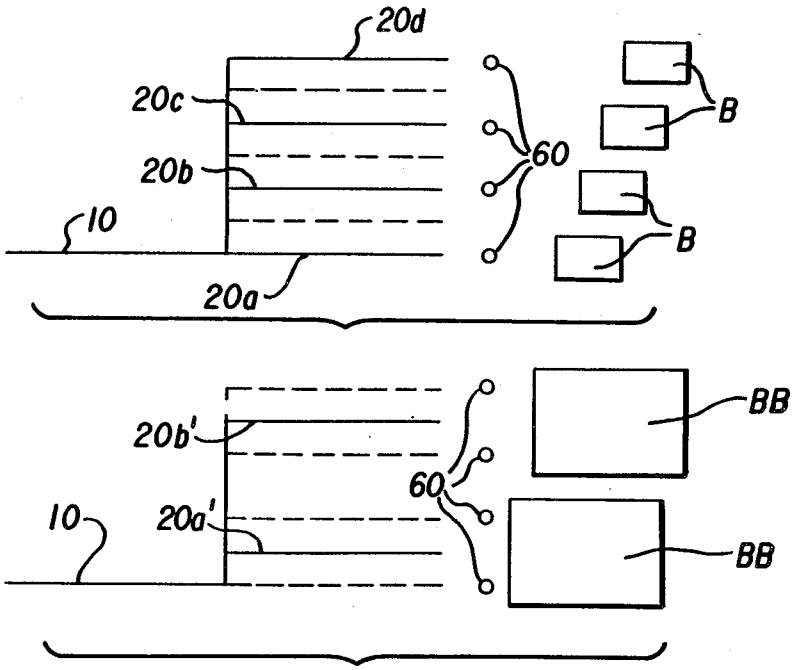
FIG. 8a
FIG. 8b
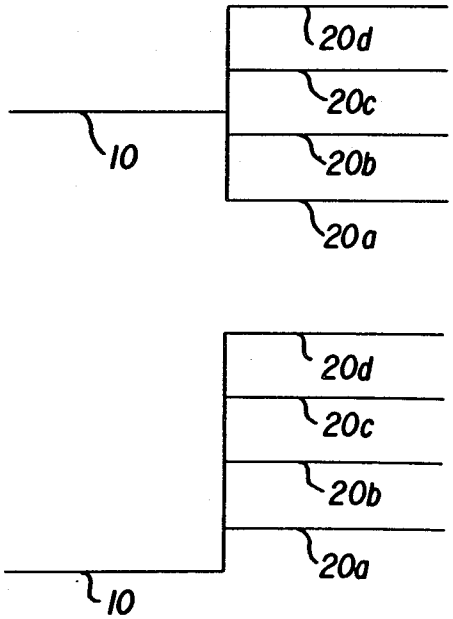
FIG. 7a
FIG. 7b

PROCESS AND APPARATUS FOR TREATING OBJECTS FORMING SEPARATE SERIES

BACKGROUND AND FIELD OF INVENTION

The invention relates to a process and corresponding apparatus for separately processing a plurality of objects belonging to separate series and subsequently collecting said objects by series. More specifically, the invention is directed to such a process and apparatus in the photographic processing environment.

In the production of photographic copies and the like, single sheet paper processors are used, which include several parallel conveyor belts for enhancing capacity. Exposed single sheets ejected by a copying device are conveyed through the necessary treating baths and drying stages. These individual sheets are ejected by the copying device according to orders, i.e., a certain number of successive sheets belong to a series. For this reason, individual orders must be strictly separated.

Separation by order heretofore was typically effected on the basis of the number of images per order which is electronically stored during copying and by counting the number of copies leaving the paper processor. This method has, however, several disadvantages and risks. For example, in case of a power failure the stored information may be lost if no special safety measures were taken. A significantly more severe disadvantage may be found, however, in that the entire system may become disoriented if one or more individual images are lost on their way through the processor. This condition remains uncorrected, except if discovered by other means, until the processor is completely discharged and the memories reset. Consequently, in case of such an error the orders must be again sorted out manually, which is time consuming and cumbersome, and should be avoided, if possible. In addition, the error cannot be detected automatically, resulting in certain conditions in which a considerable number of pictures must be reseparated.

The subject invention is designed to eliminate the above-mentioned disadvantages of the prior art.

SUMMARY AND OBJECTIVES

Specifically, the subject invention is intended to provide a distribution system capable of automatically marking and detecting transition between successive series of individual objects, thereby permitting automatic sorting by series.

It is an objective of the invention to enhance operation integrity despite occurrence of power failure.

It is a further objective of the invention to quickly determine disorientation in the system and to provide effective means for recovery.

BRIEF DESCRIPTION OF DRAWINGS

FIGS. 7*a* and 7*b* respectively illustrate alternative relationship between the input and output conveyors shown in FIG. 5*a*.

FIGS. 8*a* and 8*b* collectively illustrate the contrast between four output conveyors supporting four sheets of smaller format as opposed to the same four output conveyors supporting only two sheets of larger format.

DETAILED DESCRIPTION

Figures 1, 2:
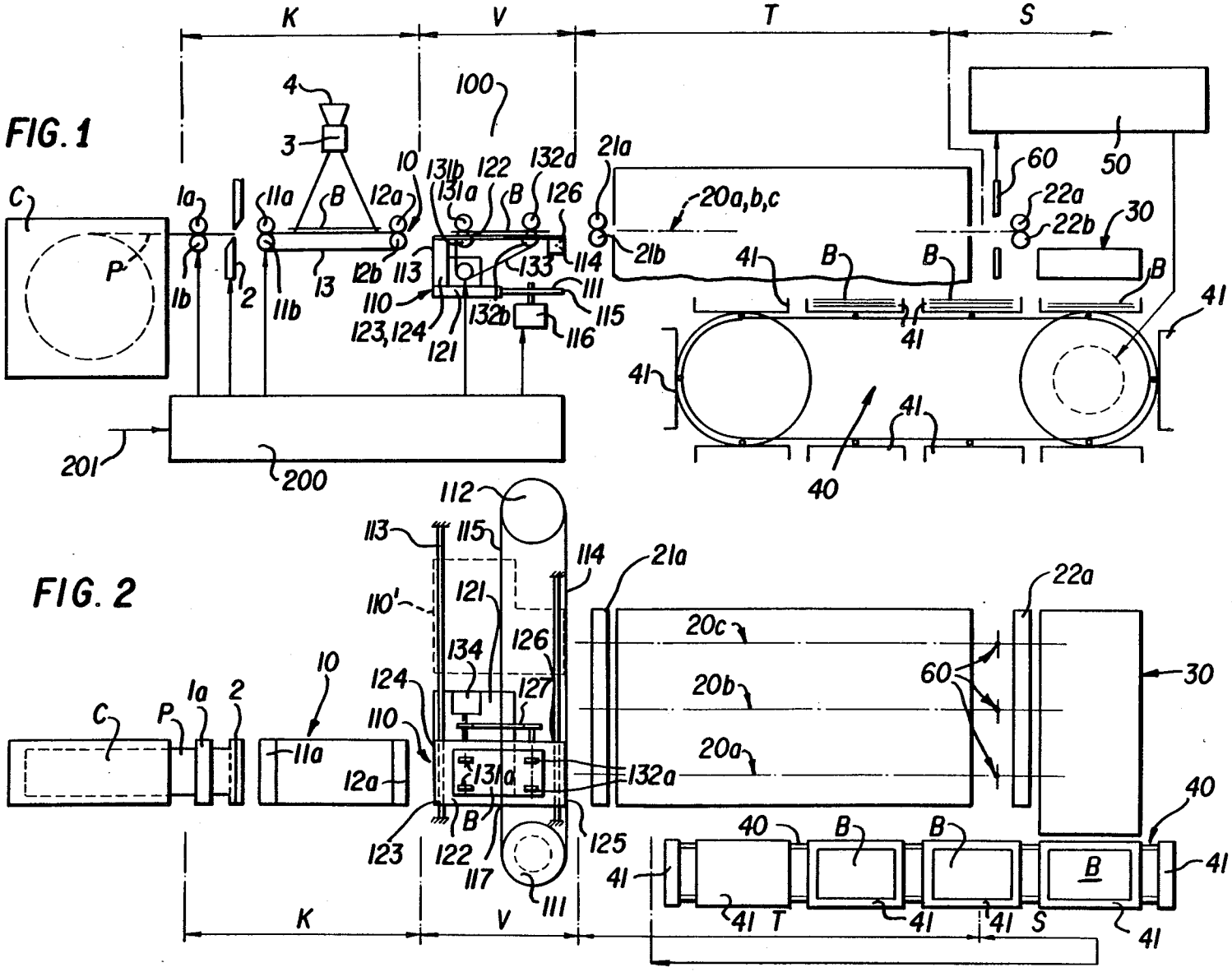
FIG. 1 shows a schematic lateral view of a laboratory apparatus for the production of photographic copies according to one embodiment of the invention.
FIG. 2 shows a schematic top view of a laboratory apparatus for the production of photographic copies according to one embodiment of the invention.
Figures 3A, 3B, 3C, 4A, 4B, 4C, 5A, 5B, 5C, 6A, 6B, 6C:
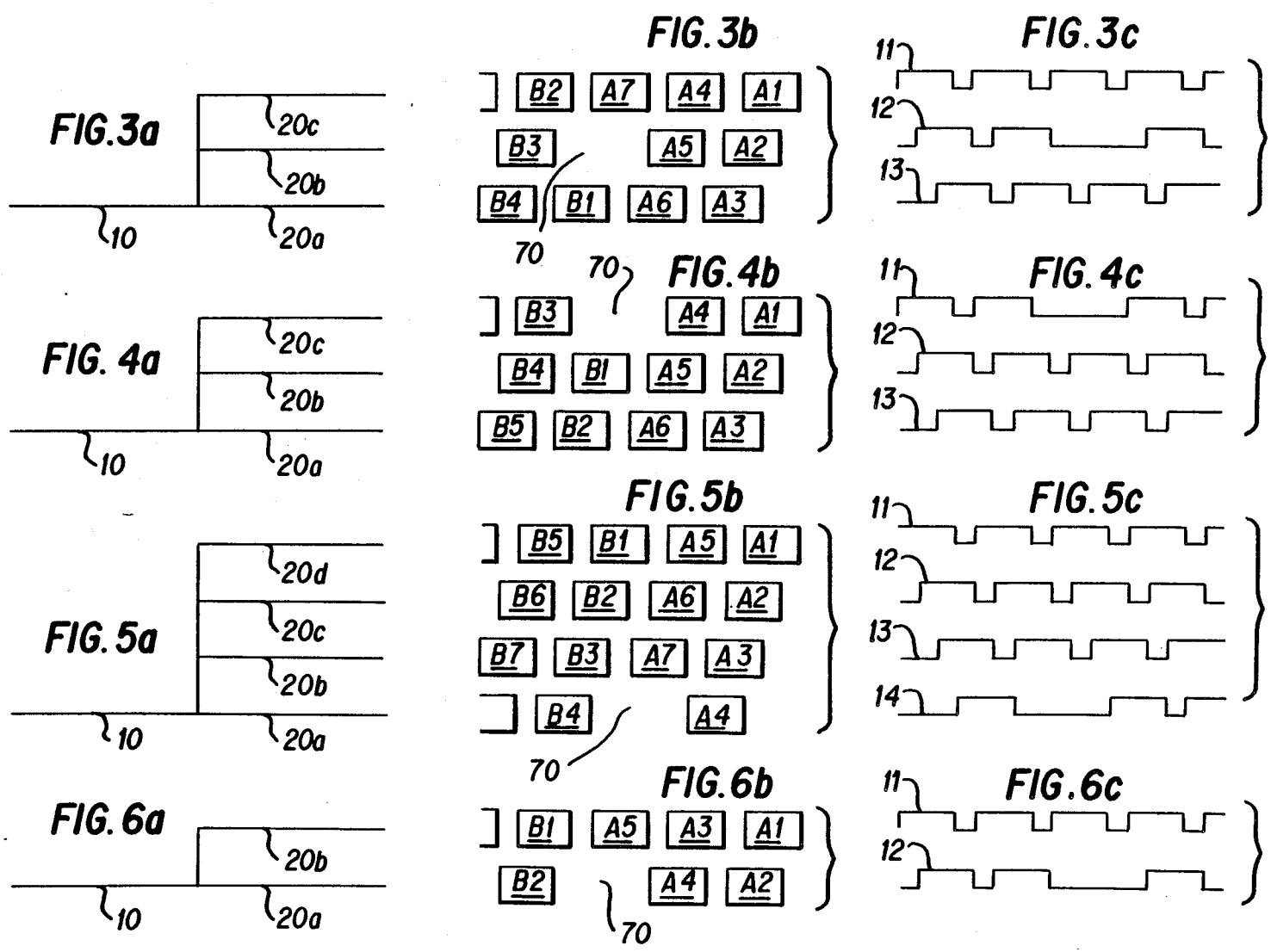
FIG. 3*a* illustrates the relationship between input and output conveyors according to one embodiment of the invention.
FIG. 3*b* illustrates the sheets carried on the output conveyors of FIG. 3A.
FIG. 3*c* illustrates the scanning signals corresponding to the sheets illustrated in FIG. 3*b*.
FIG. 4*a* illustrates the relationship between input and output conveyors according to a second embodiment of the invention.
FIG. 4*b* illustrates the sheets carried on the output conveyors of FIG. 4*a*.
FIG. 4*c* illustrates the scanning signals corresponding to the sheets illustrated in FIG. 4*b*.
FIG. 5*a* illustrates the relationship between input and output conveyors according to a third embodiment of the invention.
FIG. 5*b* illustrates the sheets carried on the output conveyors of FIG. 5*a*.
FIG. 5*c* illustrates the scanning signals corresponding to the sheets illustrated in FIG. 5*b*.
FIG. 6*a* illustrates the relationship between input and output conveyors according to a fourth embodiment of the invention.
FIG. 6*b* illustrates the sheets carried on the output conveyors illustrated in FIG. 6*a*.
FIG. 6*c* illustrates the scanning signals corresponding to the sheets illustrated in FIG. 6*b*.

Referring now to the drawings, wherein like references indicate like parts, the subject invention will be described in detail.

The apparatus shown in FIGS. 1 and 2 is a "minilab," a compact installation for preparing photographic copies. It comprises an automatic copying apparatus K, a distribution station V, a wet processing and drying station T for individual sheets and a collecting and return station S, and all of these stations are traversed by the photographic copy material P stored in a cassette C in succession.

Initially, the copy material P passes from the cassette C into the copy apparatus K and is transported from there by a pair of transport rollers 1*a*, 1*b* to a cutting device 2, which separates it into individual sheets B of the format desired. For all of the subsequent processing steps the copy material is thus present in the form of individual sheets B.

From the cutting device 2 the individual sheets B travel through a conveyor assembly consisting of two pairs of rollers 11*a*, 11*b* and 12*a* and 12*b* and a perforated endless belt 13, designated hereinafter as the input conveyor 10, into the exposure zone of the copy apparatus. The sheets B are exposed in the exposure zone by means of a projection objective lens 3 from an original lens 4 and arrive at the distribution station V.

From the distribution station V the individual sheets B are distributed over several, in this case three, parallel conveyor assemblies, designated hereinafter as output conveyors 20*a*, 20*b* and 20*c*. The output conveyors transport the sheets B though the wet treating and drying station T. Only one pair of transfer rollers 21*a*, 21*b* of the output conveyors is shown.

When the individual sheets B leave the treating station T on the three or more output conveyors, they arrive through a further pair of transfer rollers 22*a*, 22*b* in the collecting and return conveyor station S. In this station the individual sheets B are transported by a transverse conveyor 30 to a return conveyor 40 and deposited in the collecting trays 41 thereof. When all of the copies of one order are in a tray, the return conveyor 40 is actuated automatically in a manner described below, so that the copies (individual sheets B) belonging to the next order will arrive and be collected in a subsequent collecting tray 41. To guide this automatic stepping sequence, a control device 50 is provided which cooperates with a light barrier monitor device 60 extending over the output conveyors 20*a*, 20*b*, and 20*c*. The light barrier monitor device is capable of scanning the sheets B transported over the output conveyors and providing a corresponding signal indicating presence or absence and the orientation or offset of a sheet on a monitored location of each output conveyor. The control device 50 is responsive to indications from the light barrier device to guide the automatic stepping sequence. The return conveyor 40 then readies the copies for further processing (final finishing).

The distribution station V comprises a distributing device 100 and an associated electronic control unit 200, which also simultaneously controls the conveying elements 1*a*, 1*b*, 10 and the cutting device 2 in the copy apparatus K. External commands may be entered into the control unit 200 through input 201. The specific design of the hardware of the control unit 200 is conventional, provided that it is capable of actuating the functional steps described herein.

The distributing station 100 comprises essentially of a slide 110 displaceable transversely to the conveying direction of the input conveyor 10 and the output conveyors 20*a*, 20*b*, and 2O*c*, supported in a mobile manner by means of slide bearings on two slide rods 113 and 114 mounted fixedly in the apparatus. To drive the slide 110, a tooth belt 115 revolving around two rolls 111 and 112, and a drive motor 116 for the front roller 111 are provided. The drive motor 116 is controlled by the control unit 200. The slide 200 and the tooth belt 115 are joined together at point 117.

The slide 110 itself comprises essentially of a base plate 121, an upper plate 122, two connecting links 123 and 124 with slide bearings for the slide rod 113 and two further slide bearings 123 and 126 for the slide rod 114 and a bearing plate 127. In or on the latter, two conveyor roller pairs 131*a*, *b* and 132*a*, *b* are bearingly supported. The two lower rollers 131*b* and 132*b* are driven by means of a belt 133 by a motor 134 mounted on the base plate 121. The motor 134 is controlled in a manner similar to the motor 116, by the control unit 200.

The conveyor roller pairs 131*a*, *b* and 132*a*, *b* receive the individual sheets B from the input conveyor 10 and transfer them to the output conveyors 20*a*, 20*b*, and 20*c*, by means of transverse motion of the slide 110 in making distribution to the output conveyors. Specifically, the slide 110 moves into the pickup position shown in FIG. 2 by the solid line to take up a single sheet B, then moves into the transfer position desired corresponding to an appropriate output conveyor 20*a*, 20*b* or 20*c* to place the single sheet onto said output conveyor. This distribution takes place under the control of the control device 200 in keeping with a predetermined distribution pattern. This pattern may be one that is uniform and space efficient for loading the individual output conveyors, if efficiency is a matter of concern. A possible distribution pattern is cyclic, i.e, the first picture is placed on the conveyor 20*a*, the next one on the conveyor 20*b*, and the third one on the conveyor 20*c*, whereupon the sequence is repeated. Clearly, other distribution schemes are possible, and may be selected in other embodiments. A characteristic of the production of photographic copies is that individual pictures are practically always obtained in series or groups, i.e. that a variably greater or lesser number of successive sheets would belong to the same customer order. It is necessary that pictures of different orders are not intermingled. The number of individual sheets per order is known; either the control unit 200 enters it in some form, or the control system of the copy apparatus determines it itself in a conventional manner. However, mere knowledge of the number of individual pictures per order is not sufficient in actual practice to safely separate the individual orders from each other, as it may happen in the rough daily operations that an individual sheet remains suspended undetected in the wet treatment station, thereby confounding the entire image sequence. This problem is solved by the subject invention simply by the generation of a separation mark which marks the end of an order or the transition between two successive orders and which is detectable by the ight barrier monitor device 60. This separation mark may take the form of a machine detectable change in the on-going distribution pattern of the individual sheets over the output conveyors, such as the passing over of a conveyor (temporary suspension), a reversal in the direction of the cycle, a lateral offset following the same pattern, or a switch to an entirely different distribution pattern. The separation mark is detected at the outlet of the treatment station or the inlet of the collecting station by means of the light barrier monitor device. The control 50 is responsive to scanned signals of the monitor device to actuate the return conveyor 40 in a manner such that only the pictures of the same order arrive in the same tray 41. Other points for detection may be conveniently arranged by one with ordinary skill in the art along the path of the output conveyors.

If a single sheet remains in the treatment station T, thereby simulating the presence of a separation mark T, this is without severe consequences. It merely causes the distribution of the pictures of the order involved over two trays 41, whereupon order is automatically restored.

For additional control, the number of sheets between two separation marks detected may be determined and compared with set numbers in the copy apparatus. Suitable measures may be effected in cases of deviations. Optionally, simulated ends of orders could thereby be suppressed or ignored, etc.

FIGS. 3*a*–3*c*, 4*a*–4*c*, 5*a*–5*c* and 6*a*–6*c* illustrate the production of separation marks by means of four examples. In the first two examples the individual sheets are distributed over three output conveyors according to FIG. 1 and 2 and in the following two examples over four and two output conveyors. The input conveyor is indicated by the line 10 and the output conveyors by the lines 20*a*, 20*b*, 20*c* and 20*d*.

FIGS. 3*b*, 4*b*, 5*b* and 6*b* show typical single sheet arrangements on the output conveyors, which are moving to the right. The individual sheets are designated in keeping with their respective order identity by A1, A2, A3, etc. and B1, B2, B3, etc. It is seen that the sheets are distributed in all four examples according to a cyclic pattern in relative offset over the three or four or two output conveyors. Furthermore, following the end of each order, e.e., after the last sheet of a series (in this case, after the sheets designated A), a conveyor has been passed over, thereby creating a gap 70 detectable by the light barrier 60 for correspondingly evaluation by the control device 50. FIGS. 3*c*, 4*c*, 5*c* and 6*c* show the scanning signals produced by the light barriers assigned to the individual output conveyors as obtained for the sheet layouts shown (idealized) in FIGS. 3*b*, 4*b*, 5*b* and 6*b*. Various pulses marked by I1, I2, I3 and I4 in each sub-figure "c" correspond to the first sheets A1–A3 in FIGS. 3*b* and 4*b*, sheets A–A4 in FIG. 5*b* and sheets A1–A2 in FIG. 6*b*. It is seen from the pulse diagrams that the gaps may be detected very simply by monitoring the scanned single sheet pulses illustrated in FIGS. 3*c*, 4*c*, 5*c* and 6*c*.

FIGS. 7*a* and 7*b* suggest alternative possibilities of how the output conveyors 20*a*, 20*b*, 20*c* and 20*d* may be located relative to the input conveyor 10. The position of the conveyors may be set by software, optionally as a function of the width of the paper.

FIG. 8*a* illustrates the corresponding relationship between four output conveyors 20*a*, 20*b*, 20*c* and 20*d*, and four single sheets B of one format size respectively supported by one of said output conveyors. FIG. 8*b* illustrates in sharp contrast to FIG. 8*a* the corresponding relationship between the same four output conveyors 20*a*, 20*b*, 20*c* and 20*d* and only two single sheets BB of a larger format size. Both arrangements are possible with the subject invention. The same distribution station V and the same light barrier layout 60 may be used without alteration. To switch from one form to another, changes are required merely in the control of the slide and the evaluation of light barrier signals. These changes may be effected easily and simply by means of software, and a spectrum of varying format sizes may be supported in this manner.

The process and apparatus described above may be used not only for the production of photographic copies, but in all application environments wherein individual objects are transported over several conveyors and transitions between separate objects can be marked for facilitating separation of objects.

In describing the invention, reference has been made to preferred embodiments. Those skilled in the art, however, and familiar with the disclosure of the subject invention, may recognize additions, deletions, substitutions, modifications, and/or other changes which will fall within the purview of the invention as defined in the following claims.

What is claimed is:

1. In a system wherein varying numbers of objects constitute a separate series of such object, an object treatment process comprising the following steps:

placing objects arriving on an input conveyor onto a plurality of output conveyors in accordance to a predetermined distribution pattern, including the step of deviating from continuing with said predetermined distribution pattern upon encountering an object belonging to a different series, thus generating a separation mark on said output conveyors;

applying treatment to said objects on said output conveyors;

detecting said separation mark on said output conveyors;

collecting treated objects in said predetermined pattern from said output conveyors in response to detecting said separation mark;

whereby objects belonging to different series may be separately collected.

2. In a photoprocessing system wherein varying numbers of photographic sheets constitute separate series of such photographic material, a photographic treatment process comprising the following steps:

placing photographic sheets arriving on an input conveyor onto a plurality of output conveyors in accordance to a predetermined distribution pattern, including the step of deviating from continuing with said predetermined distribution pattern upon encountering an object belonging to a different series, thus generating a separation mark on said output conveyors;

applying treatment to said photographic sheets carried on said output conveyors;

detecting said separation mark on said output conveyors;

collecting treated photographic sheets in said predetermined pattern from said output conveyors in response to detecting said separation mark;

whereby photographic sheets belonging to different series may be separately collected.

3. A process as recited in claim 2, wherein said deviating step comprises the step of suspending said predetermined distribution pattern for a gap including at least one output conveyor, thus passing over said at least one output conveyor.

4. A process as recited in claim 2, wherein said deviating step comprises the step of reversing said predetermined distribution pattern.

5. A process as recited in claim 2, wherein said deviating step comprises the step of switching to a different predetermined distribution pattern.

6. A process as recited in claim 2, wherein said deviating step comprises the step of causing an offset of said sheet encountered, on an output conveyor set to receive said sheet according to said predetermined distribution pattern.

7. A process as recited in claim 2, wherein said predetermined distribution pattern is cyclic.

8. A process as recited in claim 3, wherein said predetermined distribution pattern is cyclic.

9. A process as recited in claim 4, wherein said predetermined distribution pattern is cyclic.

10. A process as recited in claim 5, wherein said predetermined distribution pattern is cyclic.

11. A process as recited in claim 6, wherein said predetermined distribution pattern is cyclic.

12. A process as recited in claim 2, further including the step of determining the number of sheets placed onto said output conveyors in between successive separation marks on said output conveyors.

13. In a photoprocessing system wherein varying numbers of objects constitute a separate series of such objects, an object treatment process comprising the following steps:

placing objects arriving on an input conveyor onto a plurality of output conveyors in accordance to a predetermined distribution pattern, including the step of deviating from continuing with said predetermined distribution pattern upon encountering an object belonging to a different series, thus generating a separation mark between different series on said output conveyors;

applying treatment to said objects placed on said output conveyors;

collecting said treated objects in said predetermined pattern to thereby separately collect each series.

14. Apparatus for treating photographic sheet material comprising:

an input conveyor for transporting a plurality of photographic sheets belonging to more than one series;

a treatment area including means for treating photographic sheets; and, means for distributing said plurality of photographic sheets transported by said input conveyor onto a plurality of output conveyors in accordance to a predetermined distribution pattern, said plurality of output conveyors transporting said distributed photographic sheets through said treatment area in which said photographic sheets are treated by said treating means;

said distributing means being operative to insert a separation mark on said plurality of output conveyors between separate series of said photographic sheets;

said separation mark being a controlled deviation from said predetermined distribution pattern of said photographic sheets on said output conveyors.

15. An apparatus for treating photographic sheets as recited in claim 14, further comprising:

means for detecting said separation mark;

means responsive to output of said detecting means, for collecting treated photographic sheets by series.

16. An apparatus as recited in claim 15, wherein said deviation from said predetermined distribution pattern is formed by suspension of said predetermined distribution pattern, skipping at least one output conveyor otherwise next in line in said predetermined distribution pattern.

17. An apparatus as recited in claim 15, wherein said deviation from said predetermined distribution pattern is formed by switching to a different distribution pattern.

18. An apparatus as recited in claim 15 wherein said collecting means further includes means for counting the number of photographic sheets between successive separation marks.

19. An apparatus as rectied in claim 16 wherein said collecting means further includes means for counting the number of photographic sheets between successive separation marks.

20. An apparatus as rectied in claim 17 wherein said collecting means further includes means for counting the number of photographic sheets between successive separation marks.

* * * * *